US006135938A

United States Patent [19]

Discacciati et al.

[11] Patent Number: 6,135,938

[45] Date of Patent: Oct. 24, 2000

[54] MACHINES FOR MANUFACTURING CONTAINERS OF PLASTIC MATERIAL SUCH AS ENVELOPES, BAGS, HANDBAGS AND THE LIKE

[75] Inventors: Diego Discacciati, La Tour du Pin, France; Uliano Margini, Carpi, Italy

[73] Assignee: American Jet Stream Inc., East Brunswick, N.J.

[21] Appl. No.: 09/413,795

[22] Filed: Oct. 7, 1999

[30] Foreign Application Priority Data

Oct. 16, 1998 [IT] Italy ..... MI98A2232

[51] Int. Cl.[7] ..... B31B 49/04

[52] U.S. Cl. ..... 493/194; 493/204; 493/224; 493/193; 493/226; 414/27

[58] Field of Search ..... 493/194, 204, 493/203, 193, 199, 230, 227, 209, 226, 926, 224; 414/908, 27; 271/903; 198/408, 470.1

[56] References Cited

U.S. PATENT DOCUMENTS

| | | | |
|---|---|---|---|
| 3,172,796 | 3/1965 | Gulker | 198/408 |
| 3,555,977 | 1/1971 | Saumsiegle | 198/408 |
| 4,861,170 | 8/1989 | Patriksson | 493/226 |
| 5,000,727 | 3/1991 | Hatchell et al. | 493/199 |
| 5,311,976 | 5/1994 | Backman | 198/470.1 |
| 5,496,252 | 3/1996 | Gilbert | 493/224 |
| 5,542,802 | 8/1996 | Woodman et al. | 414/27 |

*Primary Examiner*—Stephen F. Gerrity
*Assistant Examiner*—Sam Tawfik
*Attorney, Agent, or Firm*—Browdy and Neimark

[57] ABSTRACT

The machine (1) is provided for production of containers (8) having a trapezoid or triangular form in plane, starting from two films (4) of plastic material superposed on each other. The machine (1) comprises a work station (6) provided with a pair of heat sealing and cutting-out elements (18) extending in directions converging towards each other and transverse to the feed direction of the films (4) so as to simultaneously form two adjacent containers (8) disposed in an inverted relationship with each other in the plane of the films (4). The containers (8) are simultaneousLy removed from opposite sides of the work station (6) by respective removing means (7) provided with clamps (22) and are then released from the clamps (22) and fitted on pairs of underlying needles (36) thus forming stacks.

18 Claims, 7 Drawing Sheets

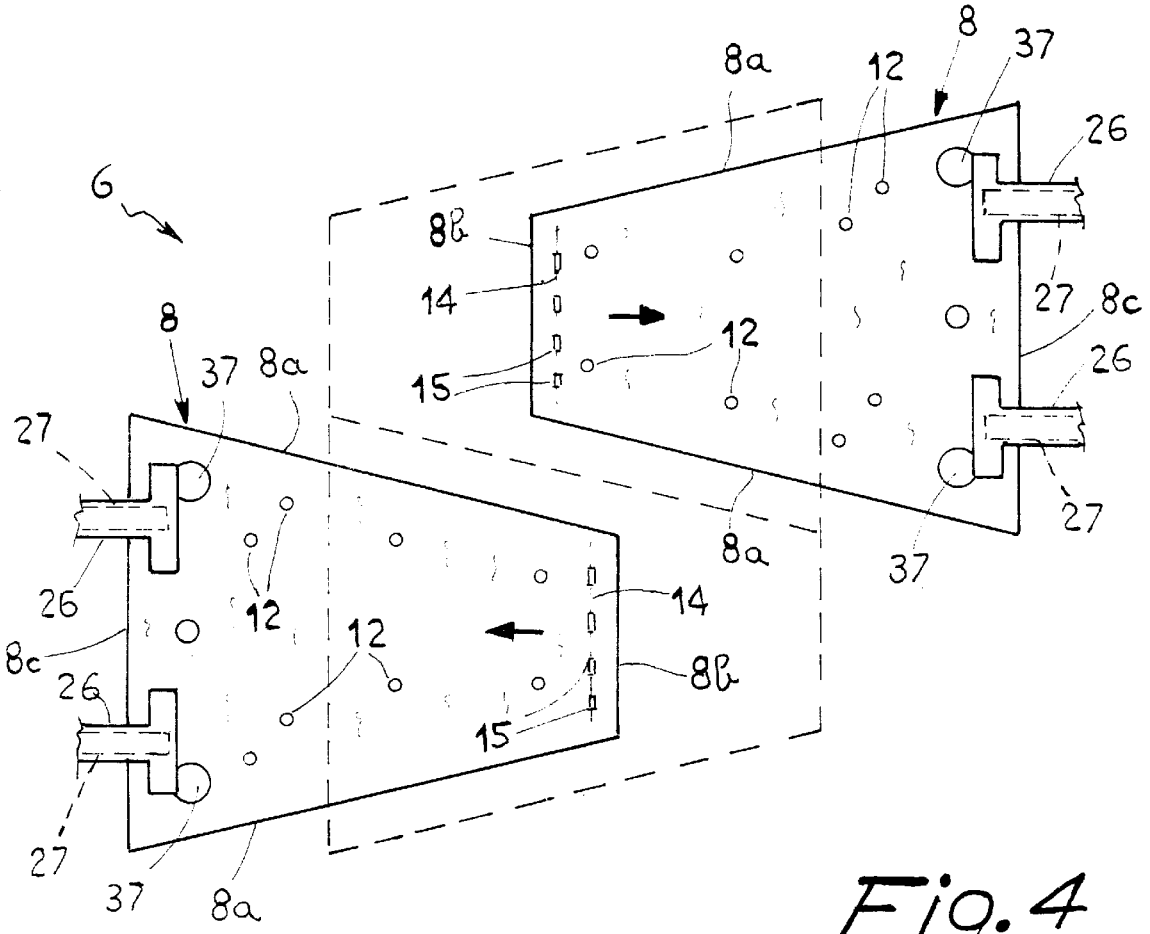
Fig. 4
Fig. 5
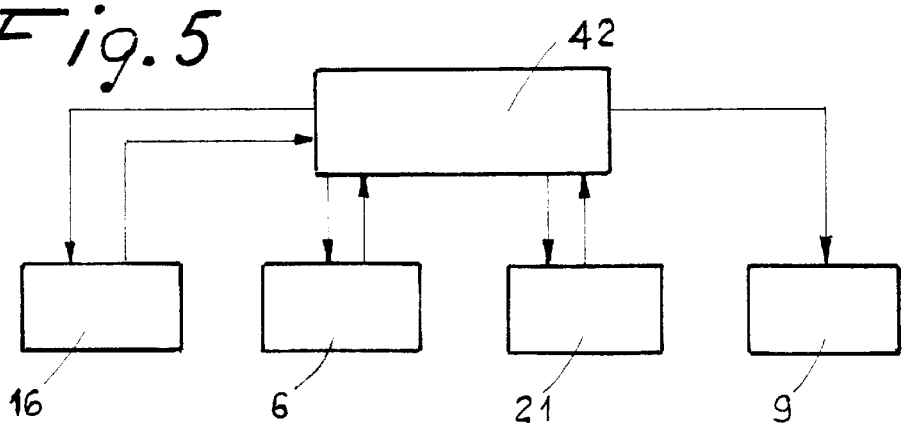

MACHINES FOR MANUFACTURING CONTAINERS OF PLASTIC MATERIAL SUCH AS ENVELOPES, BAGS, HANDBAGS AND THE LIKE

FIELD OF THE INVENTION

The invention relates to a machine for manufacturing containers of plastic material such as envelopes, bags, handbags and the like more specifically, the invention relates to manufacturing of containers such as envelopes and bags of trapezoid or triangular shape (in plane), starting from two films made of plastic material such as polyethylene. The two films are superposed and heat sealed along lines defining the container sides and said containers are cut out from the film at the heat sealed sides.

These containers can be provided with small aeration openings in their surfaces, made before heat sealing or during this operation and are mainly intended for holding bunches of grapes.

DESCRIPTION OF THE PRIOR ART

Production of these containers presently takes place with the aid of apparatuses requiring a large manual intervention, in particular for operation and control of the heat sealing and cutting-out operations to be carried out on the containers and for collection of same.

This fact adversely affects production, greatly slowing it down.

In addition, the trapezoid or triangular shape of the containers involves, in these apparatuses, an important amount of scraps, consisting of the portions of plastic material films that are close to the oblique sides of the trapezoid shape.

As a result, costs of these containers are presently rather high as compared with the obtained product, above all if we take into account the fact that generally these containers are of the disposable type.

SUMMARY OF OTHER INVENTION

Under this situation, the general aim of the invention is to overcome the limitations and drawbacks presently connected with manufacture of these containers of plastic material by accomplishing a machine enabling production of same in a completely automatic manner, to eliminate any manual intervention in manufacture and greatly increase the production rates.

Another important aim of the invention is to produce a machine of the type herein specified capable of working with a minimum amount of scraps, thus enabling the whole plastic material to be utilized and thereby further reducing the production costs.

A still further aim of the invention is to produce a machine that does not involve complicated means or mechanisms for handling the films and containers and which is therefore cheap and of safe operation.

The foregoing and further aims of the invention are substantially achieved by a machine for manufacturing containers of plastic material such as envelopes, bags, handbags and the like, comprising: means for feeding two films of plastic material, adapted to convey and bring said films to a superposed position with each other; a work station placed downstream of this feeder means and comprising heat sealing and cutting-out elements adapted to heat seal said films with each other along sealing lines defining sides of said containers, and to cut out said containers along said sealing lines; and means for removing said containers from said work station; said heat sealing and cutting-out elements being such shaped that they are able to simultaneously seal and cut out at least one pair of adjacent containers disposed in an inverted relationship with each other in the plane of said films; and said removal means being disposed on opposite sides relative to said films and offset in the feed direction of said films to remove respective containers of said at least one pair, transversely of said feed direction.

BRIEF DESCRIPTION OF THE DRAWINGS

Details and advantages of the invention will become apparent from the following description of preferred embodiments of the machine in accordance with the invention, shown in the accompanying drawings, in which:

FIG. 4 diagrammatically shows the starting step for removing containers from said work region, in a plan view;

FIG. 5 is a general flow chart of the machine in accordance with the invention;

DESCRIPTION OF THE PREFERRED EMBODIMENTS

Figure 1:
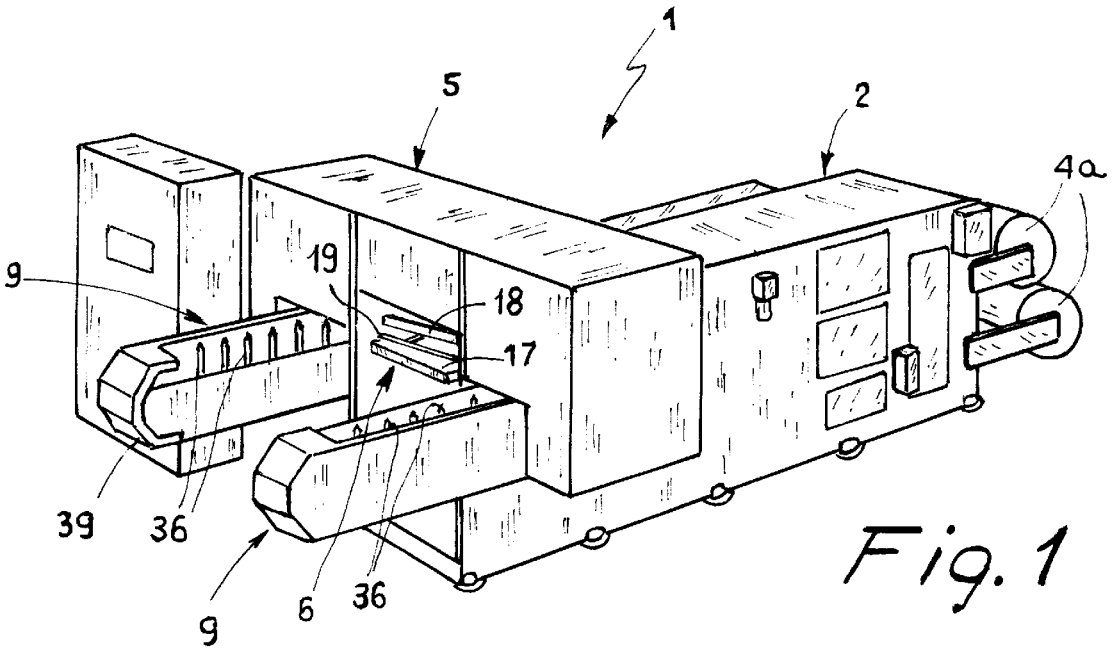
FIG. 1 is a perspective view of the machine.

The machine in accordance with the invention has been generally identified by reference numeral 1. It comprises a longitudinal body 2, in which means 3 for feeding two films 4 of plastic material, in particular transparent polyethylene, is disposed, as well as a transverse body 5 comprising a work station 6 disposed centrally and means 7 for removing heat sealed containers 8 disposed laterally. Means 9 for collecting containers 8 is arranged under the removal means 7 and extends in the longitudinal direction of machine 1.

In more detail, containers 8 in the example shown have a substantially trapezoid shape (in plane view), being obtained by heat sealing two films 4 along two oblique sides 8*a* and a minor side 8*b*. They remain open at their major side 8*c*. The feeder means 3 for the two films 4 comprises two respective reels 4*a* from which films 4 are unrolled, which films through guide rollers 4*b* and take-up rollers 10 reach respective first perforation regions 11. Said perforation regions comprise perforating means adapted to form aeration openings 12.

Openings 12 may be of different shape or configuration in the two films 4.

Figure 2:
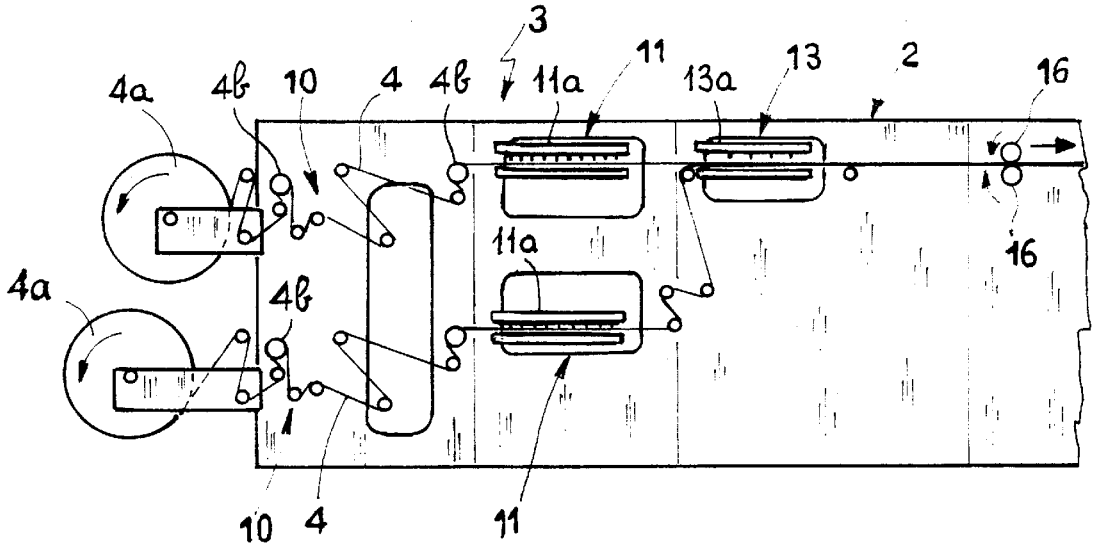
FIG. 2 is a diagrammatic section of the machine portion including the plastic-material feeding means.

Provision may be made for mere metal punches which are suitably shaped and extend perpendicularly to the film to be pierced with holes. Punches outlined in FIG. 2 are for example integral with a movable plate 11*a* and the movable plate 11*a* is operated by pneumatic members such as small air cylinders (not shown).

Then a second region 13 for perforation and heat sealing, reached by the two films 4 in a superposed condition, is. provided downstream of the first perforation regions 11. The second region 13 is provided with means adapted to perforate the two films 4 and heat seal them together along alternate sections 14 at either edge of the films 4. In particular, aligned perforation and sealing spots 15 are carried out which constitute closing lines of the container 8 bottoms at the minor side 8*a* of same.

The same structure as that in the first stations 11 is used, but the metal punches are aligned and supported by a heated movable bar 13*a*, provided with electric resistors. The hot punches seal the two superposed films together at the region surrounding the holes.

At all events, the second region 13 may be omitted and heat sealing of bottom 8*b* may be carried out together with sealing of the oblique sides 8*a* in the work station 6. The two films 4 are dragged along by rotating feed rollers 16. The intended rotation is of the intermittent type so that both the perforation and heat sealing steps in the first regions 11 and second region 13, and the heat-sealing and cutting-out step in the end work region where the work station 6 is provided, take place on the two immobile films 4.

Disposed downstream of the feed rollers 16 is a support surface 17 also extending in the end work region, under the work station 6.

A glass or plastic coating (made of Teflon, for example) is preferably arranged on the support surface 17. Disposed over surface 17 are two vertically-movable heat sealing and cutting-out elements 18 and two pressure bars 19, adapted to retain films 4 in place on surface 17 during heat sealing and cutting-out.

The heat sealing and cutting-out elements 18 are of a type known per se, as they are elements commonly used in plastics working.

As their fundamental elements they comprise sharp blades 18*a* heated to a sufficient temperature to seal the plastics films superposed on each other and placed at the cut edges. Heating of the blades is obtained by means of resistors and temperatures are controlled by appropriate thermoregulators. Heat sealing and cutting-out elements 18 are arranged in such a manner that they extend in directions transverse to the feed direction A of films 4 and converging towards each other. These directions are coincident with those of the oblique opposite sides 8*a* of the containers 8 to be made. Two identical pressure bars 19 are associated with elements 18.

The first pressure bar is inserted between elements 18 and has a configuration with two oblique sides 19*a* parallel to elements 18, one bottom side 19*b* which connects sides 19*a* at the region where they are closer to each other and which is parallel to the edge of films 4, (i.e. to the sealing section 14 of containers 8) and a transverse side 19*c* joining sides 19*a* at a distance from the bottom side 19*b*. Sides 19*a*, 19*b* and 19*c* are all internal to the area of the containers 8 to be made.

Figure 3:
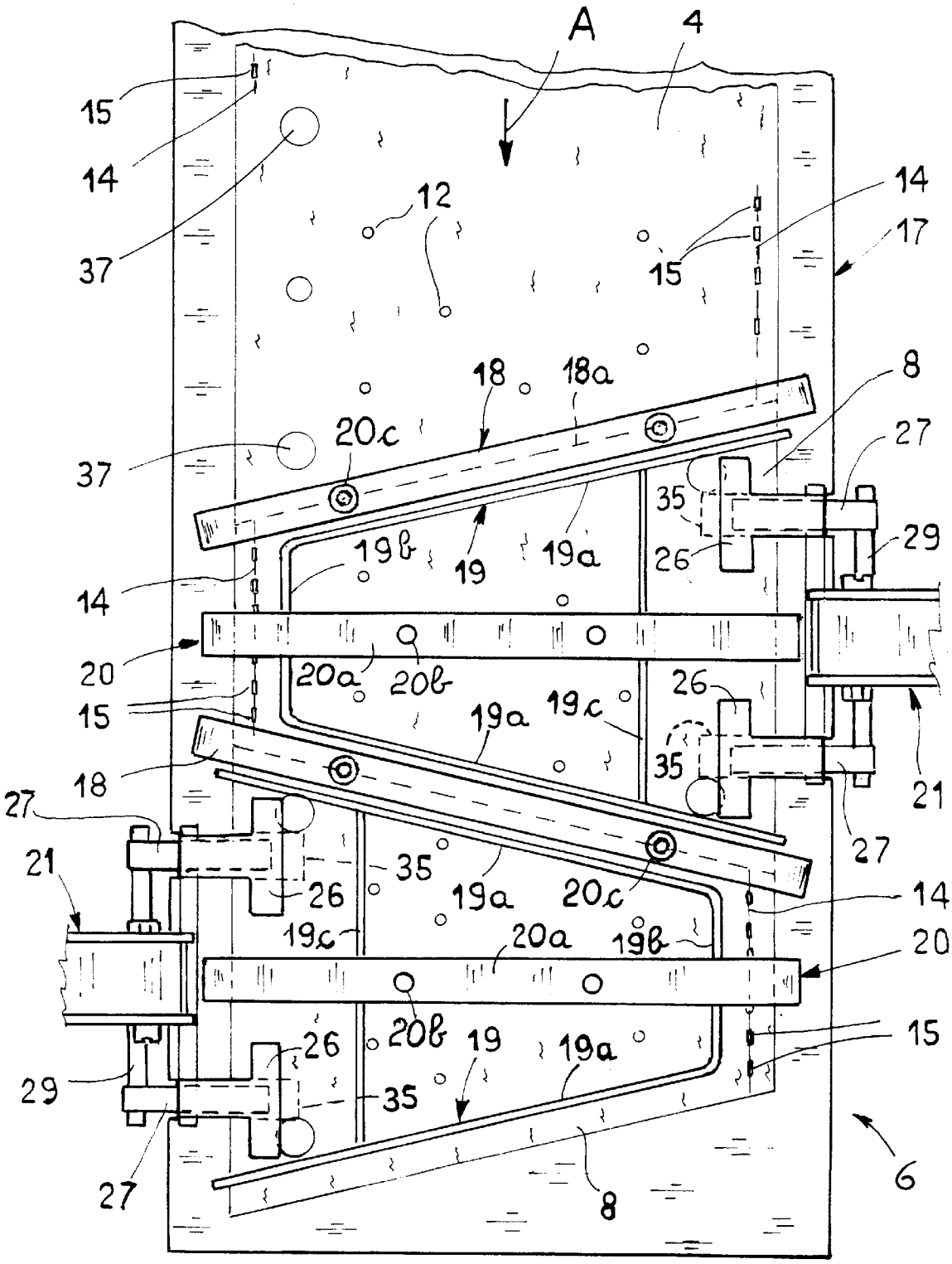
FIG. 3 is a plan view of the end work portion.

A second pressure bar 19, of the same configuration as the above described one, is disposed in an inverted relationship with the first bar, downstream of the latter in the direction A, as shown in FIG. 3.

The second bar 19 has only one of its sides 19*a* associated with a heat sealing and cutting-out element 18, more specifically the one that in the direction A is more downstream, whereas no element 18 is disposed at the other side 19*a* of this bar 19.

Configuration and arrangement of bars 19 and elements 18 advantageously enables two adjacent containers 8 disposed in an inverted relationship with each other in the plane of films 4 to be simultaneously heat sealed and cut out. Practically, containers 8 appear alternately oriented on either side.

The heat sealing and cutting-out elements 18 and pressure bars 19 are supported by a support structure 20. Structure 20 is operated while the feed rollers 16 are stopped and carries out translation in a vertical direction both of the heat sealing and cutting-out elements 18 and pressure bars 19. The support structure 20 comprises a mechanical trestlework supporting elements 18 and bars 19 separately and from top and a series of vertical air cylinders giving rise to all movements in a vertical direction. The air cylinders are supplied with compressed air and controlled by appropriate pressure gauges.

The air cylinders and mechanical trestlework are common and of a type usually conceived in pneumatically-operated mechanical applications and therefore the support structure 20 is shown only partially: crosspieces 20*a* supporting the pressure bars 19 at sides 19*b* and 19*c*, upper attachments 20*b* for crosspieces 20*a* and engagement points 20*c* for heat sealing and cutting-out elements 18 are highlighted. Disposed laterally of the support surface 17, but offset in the feeding direction A of films 4, are removal means 7 for the containers 8. These means are arranged on either side of the support surface 17, extend transversely of the direction A and are each aligned with one of the heat sealed containers 8 in the work station 6.

Figure 6:
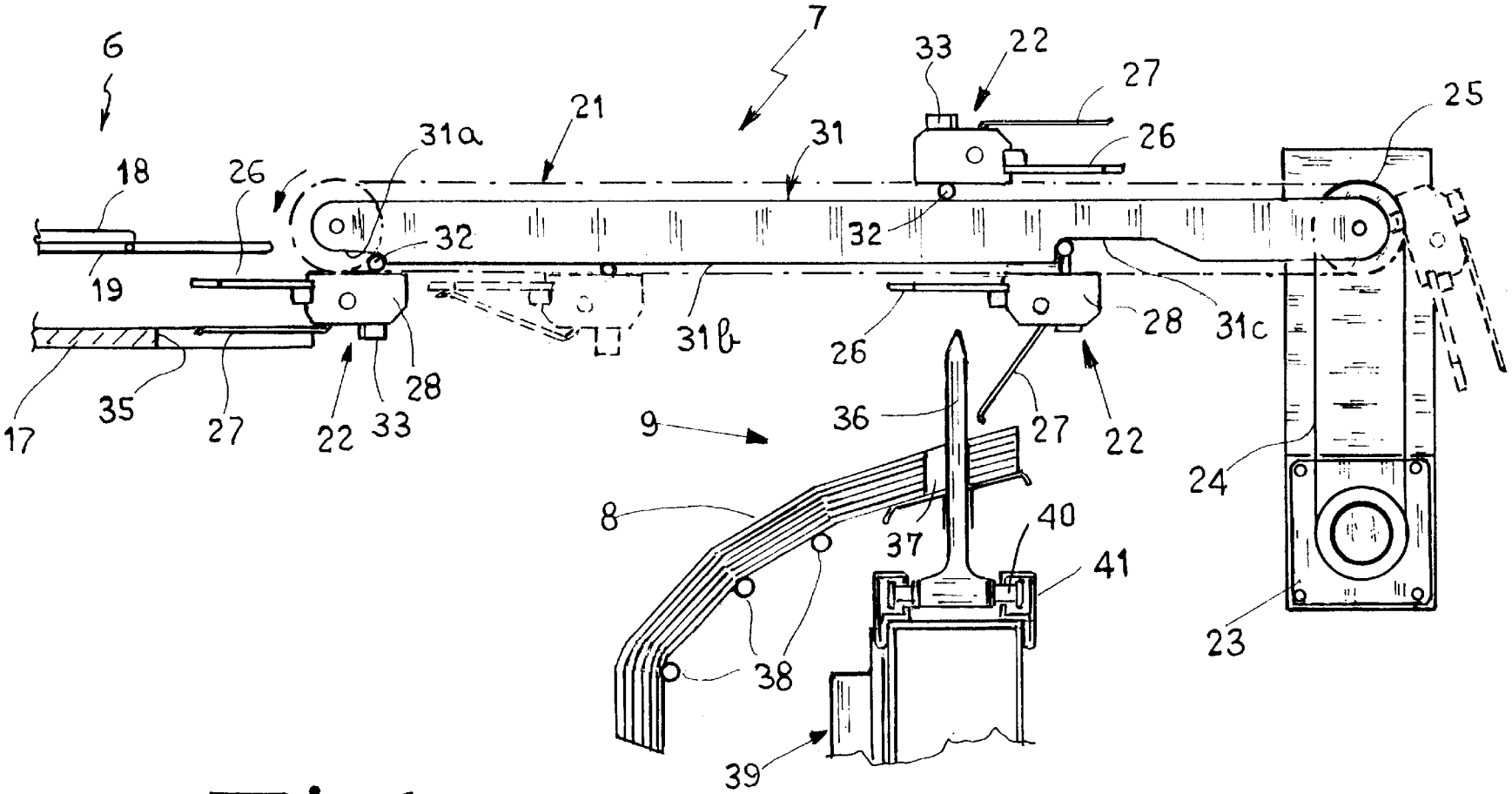
FIG. 6 is a side view of the removal and collection means for the containers and the related clamps.

The removal means 7 preferably consists of conveyors 21, in particular double-chain conveyors, each provided with a plurality of clamps 22 for grip and transport of containers 8, in particular three or more clamps spaced apart the same distance along the endless path of the chains, as shown in FIG. 6.

Conveyors 21 are simultaneously but intermittently operated, each by a respective motor 23 by means of a belt or a chain 24 acting on a chain pulley or wheel 25 integral with an idler wheel of the respective conveyor 21. Operation takes place at the end of each heat sealing and cutting-out step carried out on containers 8.

Each clamp 22 comprises, when disposed in the work station 6, an upper arm 26 and a Lower arm 27, both of the plate-like type, one of which is preferably movable and the other fixed. Each clamp 22 has, when it is placed in the work station 6, its upper arm 26 fixed and its lower arm 27 movable. In this manner during the gripping step it carries out partial raising of containers 8 from the support surface 17, thereby facilitating separation from said support surface on which the films 4 of plastic material had been pressed.

Each fixed arm 26 is integral with a body 28 of the respective clamp 22 and has two clamping tailpieces disposed in side by side relationship and spaced apart from each other. Each tailpiece has a substantially T-shaped configuration, the wider portion being disposed at the free end thereof.

Figure 7:
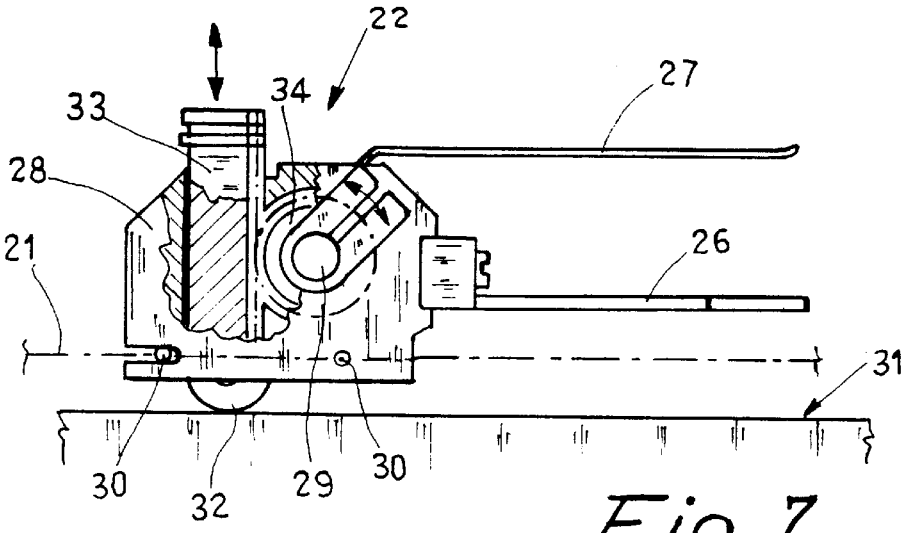
FIG. 7 is a view, partly in section, of one of the clamps being part of the removal means shown in the preceding figure.

Each movable arm 27 is integral with a rotating pivot 29 (FIG. 7) and in turn has two clamping tailpieces disposed in side by side relationship and spaced apart from each other like said tailpieces of the fixed arm 26. Pivot 29 passes through the body 28 of clamp 22 in a direction perpendicular to the advance or feed direction of the clamp.

The body 28 of each clamp 22 is fastened to the chain conveyor 21 by a pair of pawls 30 at the articulation axes of two chain links.

The movable arms 27 can be operated to a grip position and release position of containers 8 by actuating means that in the example in FIG. 6 is of the cam type.

This actuating means comprises a fixed cam 31, with a profile extending along the endless path of the respective chain conveyor 21, in particular inside the same and a cam follower 32, associated with each clamp 22 and rotatably supported by a rack rod 33, movable in the body 28 of clamp 22. The rod 33 engages, by its toothing, a sprocket 34 fixed to pivot 29, so that the rectilinear movement of rod 33 is converted to a rotary movement of the movable arms 27. The cam follower 32 is maintained in engagement with cam 31 through spring means preferably consisting of a torsion spring disposed around pivot 29 and having one end fixed to pivot 29 and the other end fastened to the body 28 of clamp 22.

The cam profile 31 can be seen in FIG. 6. It has, at the work station 6, a section 31a adapted to keep clamps 22 open. This section 31a may be also provided before station 6, in particular over the whole upper portion of conveyors 21. Due to the above arrangement, at the work station 6 the movable or lower arms 27 of clamps 22 are disposed inside recesses 35 formed in the support surface 17, so that the upper arm surfaces are flush with surface 17, and in such a manner that containers 8, on their removal, are raised being separated from the work surface 17. By lifting containers 8 also the risk that the clamps may get closed under the level of the support surface 17 thereby deforming containers 8 is avoided.

On the contrary the fixed or upper arms 26 remain above the movable arms 27 and the work surface 17.

It is to be noted that the distance between the clamping tailpieces of each arm disposed in side by side relationship is smaller that the maximum width of containers 8 and at all events it does not interfere with the pressure bars 19 and the heat sealing and cutting-out elements 18. Downstream of section 31*a*, but still at the work station 6, cam 31 has a raised section 31*b*, adapted to close clamps 22 after the heat sealing and cutting-out step, as shown for clamp 22 in chain line on the left in FIG. 6.

Section 31*b* is followed by a depressed section 31*c*, adapted to suddenly open clamps 22. Section 31*c*, only extending over a small portion of cam 31, is then followed by a new section 31*a*, or section 31*a* may be reached by another raised section involving partial reclosing of clamps 22.

The collecting means 9 of containers 8 is advantageously disposed at the opening point of clamps 22 defined by the recessed section 31*c* of cam 31, under each conveyor 21. This means preferably consists of a plurality of pairs of needles 36 the point of which extends upwardly and which are adapted to receive in succession the containers 8 provided with appropriate hooking holes 37 for these needles 36, as shown in FIG. 6. Associated with needles 36 are support elements 38 enabling a great number of these containers 8 to be stacked.

Advantageously needles 36 are arranged on a bearing structure 39 and are movable stepwise in the feed direction of films 4, so that new pairs of needles 36 are presented to the collecting region each time a preceding pair has been sufficiently loaded.

The bearing structure 39 may, for example, comprise a chain 40 carrying needles 36 and extending in the longitudinal direction of the machine 1, within a fixed shield 41. The different operating steps of the machine 1 in accordance with the invention are controlled by a central control unit 42 (FIG. 5), sequentially activating and deactivating the machine members.

These steps will be now described with reference in particular to FIGS. 8*a* to 11.

Figure 8A:
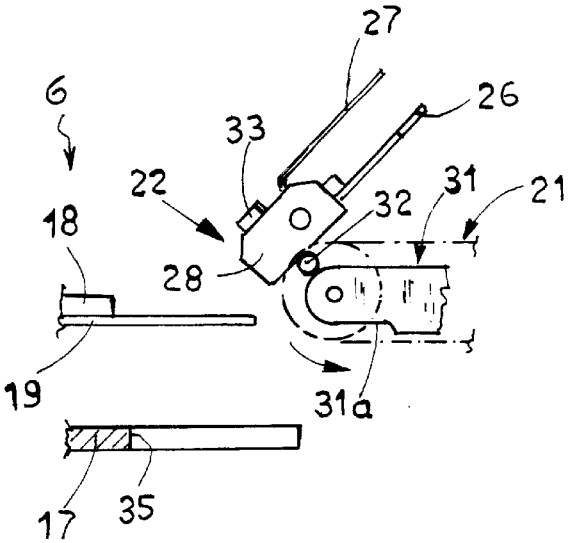
FIGS. 8*a*, 8*b* are partial side views of two successive steps of positioning said clamps at the end work region.
Figure 8B:
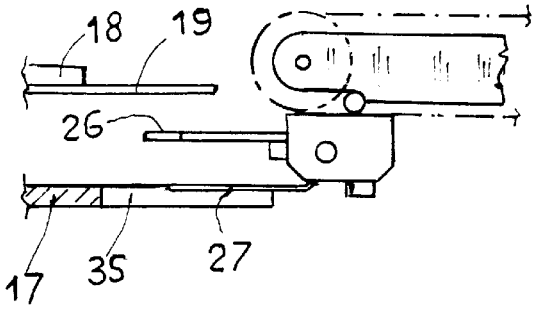

At the beginning of an operating cycle a respective clamp 22 of each of the conveyors 21 coming from the position in FIG. 8*a* takes place in the stand-by position at the work station 6 (FIG. 8*b*).

In this position the movable or lower arms 27 are housed in the recesses 35 of surface 17, flush with said surface.

The heat sealing. and cutting-out means is in the inactive raised position.

Figure 9A:
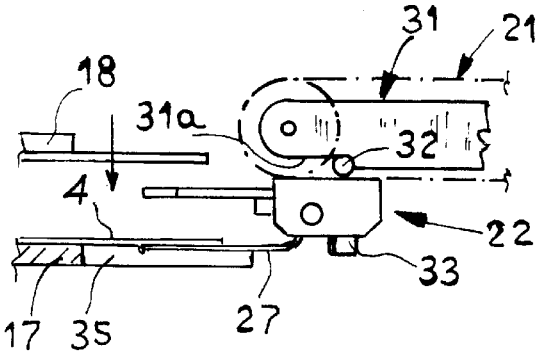
FIGS. 9*a*, 9*b*, 9*c* show carrying out and end of the heat sealing and cutting-out steps respectively, in the same manner as shown in the preceding two figures.

The two coupled films 4, already provided with openings 12 and possibly also with sealing sections 14, are now moved forward by one step and positioned under the heat sealing and cutting-out means (FIG. 9*a*).

Figure 9B:
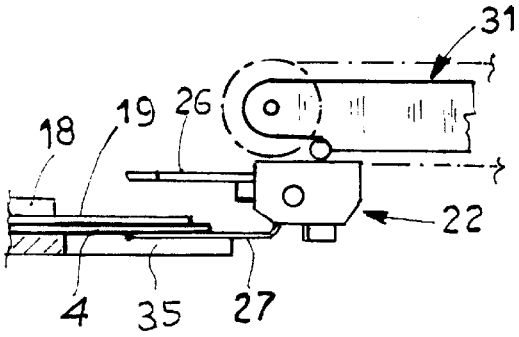
Figure 9C:
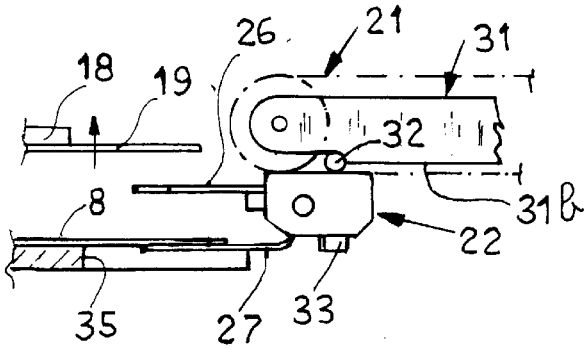

Then the pressure bars 19 and the heat sealing and cutting-out elements 18 are lowered and the heat sealing and cutting-out operations are carried out (FIG. 9*b*).

It is to be noted that during this step only two heat seals and two cut-outs on two oblique sections are carried out, i.e. the separation side of two adjacent containers 8 and the separation side of the second container (the backward one) from the coupled films 4 that are coming forward. In fact, the other oblique side of-container 8 in a more forward position has been already heat sealed and cut out in the preceding cycle and does not require any further intervention.

Figure 10A:
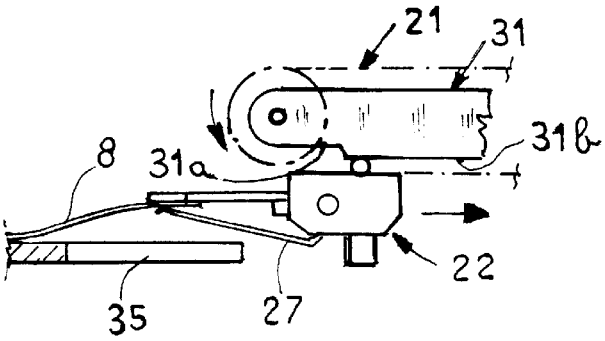
FIGS. 10*a*, 10*b* show two successive steps for removal of the heat sealed and cut-out containers, in the same manner as shown in the preceding figures.

At the end of this step, elements 18 and bars 19 are raised (FIG. 9*c*) and conveyors 21 are set in motion. Their movement involves immediate closure of clamps 22 disposed at the sides of the two just cut out containers 8, due to passage of follower 32 from section 31*a* to the raised section 31*b* of cam 31, which causes translation of the rack rod 33 and rotation of the movable arms 27 towards containers 8 and the fixed arms 26, thus lifting and clamping said containers 8 while clamps 22 are moving them away (FIG. 10*a*).

Thus the two containers 8 are simultaneously withdrawn without hindering each other, as they are each removed from the side where their width is the greatest (FIG. 4). It will be recognized that no scraps are present on surface 17 due to the inverted arrangement of containers 8 of trapezoid shape. Now the front oblique transverse edge of the coupled films 4 is already at the right position, being conveniently heat sealed and cut out and further working in the subsequent cycle is not required.

Figure 10B:
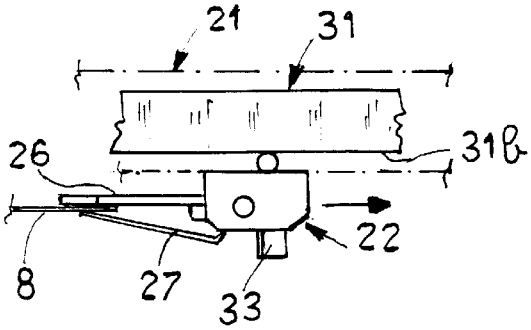

Meanwhile clamps 22 go on in their movement holding the respective containers (FIG. 10*b*).

Figure 11:
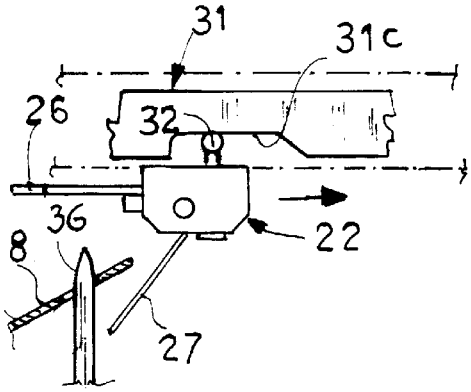
FIG. 11 shows the final step of collecting the already removed containers.
Figure 12A:
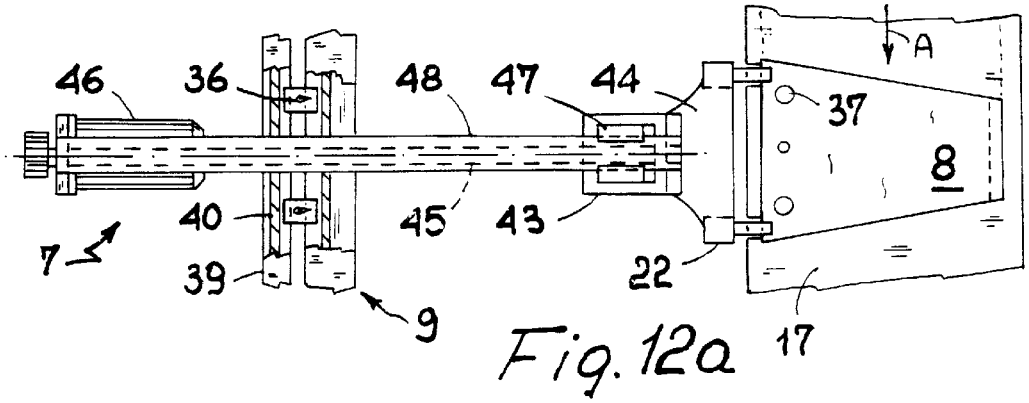
FIGS. 12*a* and 12*b* are a plan view and an elevation side view respectively of another preferred embodiment of the container-removing means, shown with the clamps placed close to the end work region.
Figure 12B:
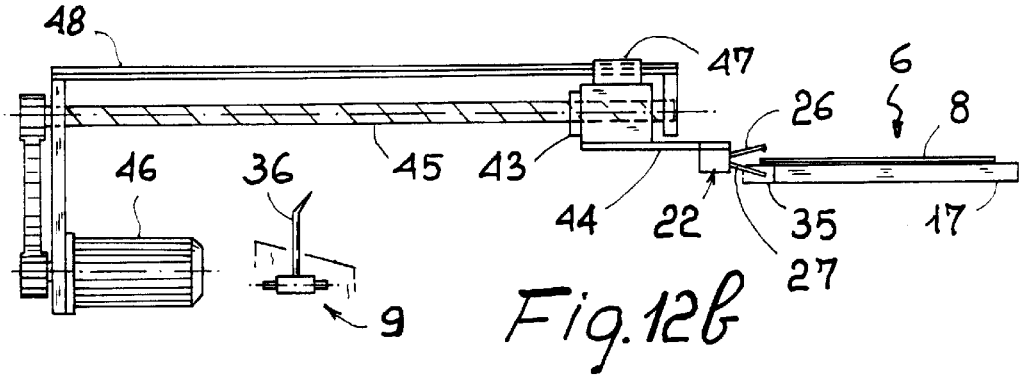
Figure 13:
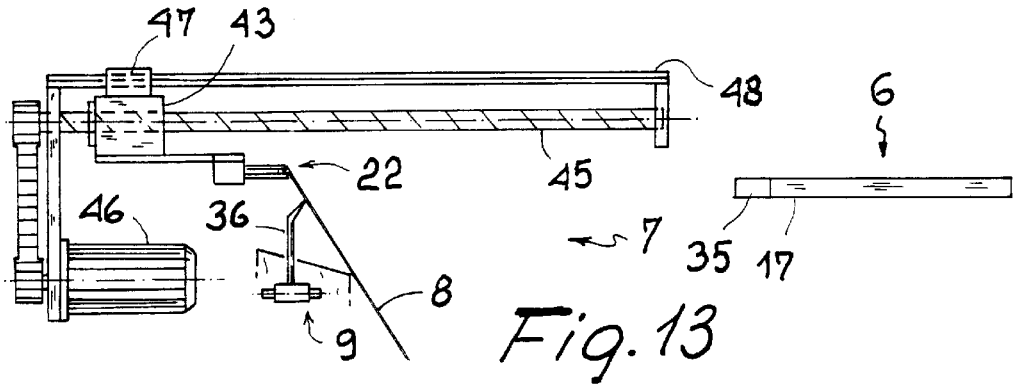
FIG. 13 depicts the container-removing step carried out by the means shown in the preceding two figures.
Figure 14:
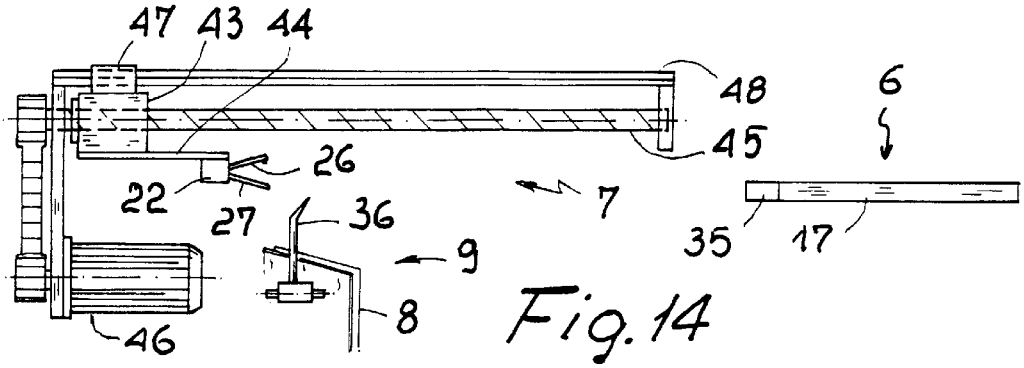
FIG. 14 shows the container-collecting step following the step shown in the preceding figure.

When clamps 22 reach needles 36, they are immediately opened due to the recessed section 31*c*, the respective containers 8 are released and they fall down in such a manner that their holes 37 are passed through by the underlying pair of needles 36 (FIG. 11).

At this moment another clamp 22 of each conveyor 21 is about to reach the work station 6 (FIG. 8*a*) and a new cycle begins. Shown in FIGS. 12*a*, 12*b*, 13, 14 is another preferred embodiment of the removal means 7 for containers 8. According to this partly variant embodiment the removal means 7, still extending transversely of direction A and each aligned with one of containers 8 heat sealed in the work station 6, may each comprise a single clamp 22 for grip and transport of containers 8.

In addition clamp 22 may be susceptible of linear translation with a reciprocating motion: it may move forward to an open position towards films 4 to be heat sealed and cut out and backward to a closed position holding a clamped container 8. Clamp 22 still has two arms 26 and 27 and it arranges itself with an arm in the recess 35 of the support surface 17, at a position in which it holds container 8 to be withdrawn. One or both arms can be operated pneumatically. For movement of clamp 22 a carriage 43 is provided which is joined to the clamp by a plate 44.

Carriage 43 is slidable with a linear reciprocating motion upon command of an operating screw 45 with ball recirculation for example, controlled by a servomotor 46. Carriage 43 engages the operating screw 45 and is slidable and not rotatable, due to the presence of a slider 47 integral with carriage 43 and movable on a prismatic guide 48.

Depending on the direction of rotation of the servomotor 46 and the operating screw 45, carriage 43 slides linearly in either way.

The invention achieves important advantages.

In fact, the sequence of the operating steps is very quick and the work rhythm of the machine is very swift. Manual interventions are not required since the whole operating cycle is automatic.

As a result, not only the machine enables savings in manpower costs, but a high production is also achieved due to the work speed and to the fact that two containers are simultaneously produced and piled up.

The films of plastic material are completely utilized, without leaving scraps, so that from the same amount of material a greater number of containers can be obtained as compared with the known art, the container sizes being the same.

The machine has a simple structure and is capable of ensuring a safe operation.

It will be recognized that also the removal means 7 shown in FIGS. 12*a* to 14 enables a particularly high speed of the clamps to be achieved and do not require positioning of the clamps at a stand-by position in the work station 6 before moving forward of films 4.

The invention is susceptible of many variations.

For example, more than two containers 8 could be produced each time, for instance four containers disposed in pairs. The seating sections 14 could be obtained in the work station 6 by correspondingly arranging the heat sealing elements 18. The carriage could be operated pneumatically and the removal means 7 could be provided with suction cups and the collecting means 9 with suction elements.

What is claimed is:

1. A machine for manufacturing containers of plastic material characterized in that it comprises:

means for feeding two films of plastic material having longitudinal edges, adapted to convey and bring said films to a superposed position with each other;

a work station placed downstream of this feeder means and comprising heat sealing and cutting-out elements adapted to heat seal said films with each other along sealing lines defining sides of said containers, and to cut out said containers along said sealing lines; and first and second means for removing said containers from said work station;

said heat sealing and cutting-out elements being such shaped that they are able to simultaneously seal and cut out at least one pair of adjacent containers disposed in an inverted relationship with each other in the plane of said films;

and said first and second removing means being respectively adjacent disposed adjacent opposite sides longitudinal edges said films and offset in the feed direction of said films to remove respective containers of said at least one pair in opposing directions transverse to said feed direction respectively.

2. A machine as claimed in claim 1, comprising perforating means associated with said feeder means and adapted to form openings in at least one of said films.

3. A machine as claimed in claim 1, comprising means adapted to carry out heat sealing of said films along alternate sections placed at the edges of said films and defining closure lines for the bottom of said containers, said means being associated with said feeder means.

4. A machine as claimed in claim 1, wherein said work station comprises a pair of heat sealing and cutting-out elements extending in directions converging towards each other and corresponding to two opposite sides of said containers, and pressure bars adapted to retain said films during the heat sealing and cutting-out step.

5. A machine as claimed in claim 1, wherein said first and second removing means comprises first and second conveyors provided with clamps for gripping and transport of said containers, intervention of said conveyors taking place at the end of each heat sealing and cutting-out step.

6. A machine as claimed in claim 5, wherein said conveyors each support a plurality of said clamps and each comprise a chain for dragging along said clamps, extending along an endless path.

7. A machine as claimed in claim 5, wherein each of said clamps, when positioned at said work station, has at least one lower arm and at least one upper arm superposed with each other and wherein at least one of said arms can be moved close to the other arm, actuating means being provided for reciprocating at least said movable arm between a grip position and a release position of said containers.

8. A machine as claimed in claim 7, wherein in said work station a support surface for said films is provided which comprises at least one recess adapted to receive said lower arm so as to dispose it under said films, said upper arm being susceptible of positioning at a distance above said lower arm.

9. A machine as claimed in claim 8, wherein said lower arm is movable to lift a said container from support surface, when said lower arm is housed in one said recess.

10. A machine as claimed in claim 7, wherein each of said arms has a pair of clamping tailpieces disposed in side by side relationship and spaced apart from each other.

11. A machine as claimed in claim 7, wherein said actuating means is of a cam type and comprises a fixed cam of a profile extending along the path of said conveyors, at least one cam follower associated with a respective clamp, a rack rod movable in said clamp and supported by said cam follower, a sprocket in engagement with said rack rod, and a pivot substantially perpendicular to the feed direction of said clamp and coaxially integral with said sprocket, and wherein one said arm of said clamp is engaged with said pivot, spring means being provided for keeping said cam follower in contact with said fixed cam.

12. A machine as claimed in claim 11, wherein said fixed cam has, at said work station, a cam section adapted to keep said clamps open before and during the step involving arrival of said films and heat sealing and cutting out of said containers, and a next raised section adapted to close said clamps after the step of heat sealing and cutting out of said containers.

13. A machine as claimed in claim 5, wherein said containers have hooking holes and wherein collecting means is associated with said conveyors at a lower part thereof, which collecting means is adapted to engage said heat sealed containers at said hooking holes.

14. A machine as claimed in claim 13, wherein said collecting means comprises needles extending upwardly and adapted to be inserted in said hooking holes.

15. A machine as claimed in claim 14, wherein a step-like movable structure supporting said needles is provided.

16. A machine as claimed in claim 5, wherein said first and second removing means have each one said clamp which is linearly shiftable, moving forward in an open position towards said work station and moving backward in a closed position with said containers clamped, in a movement direction transverse to the moving forward direction of said films.

17. A machine as claimed in claim 16, wherein said at least one clamp has at least one movable arm to be operated pneumatically.

18. A machine as claimed in claim 16, wherein said clamp provision is supported by a carriage, at least one operating screw rotatably engaging said carriage and passing therethrough, said operating screw defining said movement direction, a servomotor adapted to set said operating screw in rotation, a prismatic guide parallel to said operating screw, and a slider integral with said carriage and engaged with said guide.

* * * * *